US009984808B2

(12) United States Patent
Miyoshi

(10) Patent No.: US 9,984,808 B2
(45) Date of Patent: May 29, 2018

(54) ELECTRONIC COMPONENT AND METHOD FOR MANUFACTURING ELECTRONIC COMPONENT

(71) Applicant: MURATA MANUFACTURING CO., LTD., Kyoto-fu (JP)

(72) Inventor: Hiromi Miyoshi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days. days.

(21) Appl. No.: 15/433,259

(22) Filed: Feb. 15, 2017

(65) Prior Publication Data

US 2017/0287620 A1 Oct. 5, 2017

(30) Foreign Application Priority Data

Apr. 5, 2016 (JP) ..... 2016-076019

(51) Int. Cl.
*H01F 5/00* (2006.01)
*H01F 27/28* (2006.01)
*H01F 41/04* (2006.01)

(52) U.S. Cl.
CPC ..... *H01F 27/2804* (2013.01); *H01F 41/041* (2013.01); *H01F 2027/2809* (2013.01)

(58) Field of Classification Search
USPC ..... 336/200
See application file for complete search history.

(56) References Cited

U.S. PATENT DOCUMENTS 8,201,318 B2 * 6/2012 Yamano ..... H01F 17/0013 29/602.1
2006/0006972 A1 * 1/2006 Tozawa ..... H01F 17/0013 336/200
2010/0253464 A1 * 10/2010 Miyoshi ..... H01F 17/0013 336/200
2013/0015937 A1 * 1/2013 Seko ..... H01F 17/0013 336/200
2013/0176096 A1 * 7/2013 Takahashi ..... H01F 27/2804 336/200
2014/0145845 A1 * 5/2014 Sattari ..... G08B 21/24 340/539.13

(Continued)

FOREIGN PATENT DOCUMENTS

JP 2007-123726 A 5/2007

*Primary Examiner* — Ronald Hinson
(74) *Attorney, Agent, or Firm* — Studebaker & Brackett PC

(57) ABSTRACT

An electronic component includes a substantially helix-shaped inductor including inductive conductor layers on insulator layers including a first inductive conductor layer and a second inductive conductor layer adjacent to the first inductive conductor layer on the upper layer side. Each of the first and second inductive conductor layers has a contact portion and a linear portion. The contact portion is, when viewed in the laminating direction, overlapped by an inductive conductor layer adjacent thereto on the lower or upper layer side. The linear portion is not overlapped by inductive conductor layers adjacent thereto on the lower and upper layer sides. The lower surface of the linear portion of the second inductive conductor layer is positioned higher than that of the first inductive conductor layer, and is positioned lower than the upper surface of the linear portion of the first inductive conductor layer.

15 Claims, 15 Drawing Sheets

(56) References Cited

U.S. PATENT DOCUMENTS

| | | | | |
|---|---|---|---|---|
| 2015/0137929 | A1* | 5/2015 | Park | H01F 17/0013 336/200 |
| 2015/0371757 | A1* | 12/2015 | Takezawa | H01F 17/0013 336/200 |
| 2016/0141102 | A1* | 5/2016 | Tseng | H01F 41/042 336/192 |

* cited by examiner

ELECTRONIC COMPONENT AND METHOD FOR MANUFACTURING ELECTRONIC COMPONENT

CROSS REFERENCE TO RELATED APPLICATIONS

This application claims benefit of priority to Japanese Patent Application 2016-076019 filed Apr. 5, 2016, the entire content of which is incorporated herein by reference.

TECHNICAL FIELD

The present disclosure relates to an electronic component and a method for manufacturing the electronic component, and more particularly, relates to an electronic component including an inductor and a method for manufacturing the electronic component.

BACKGROUND

As a disclosure for an electronic component in the related art, for example, a multilayer electronic component described in Japanese Unexamined Patent Application Publication No. 2007-123726 is known. The multilayer electronic component includes a multilayer body and an inductor. The multilayer body has a structure in which multiple layered insulators are laminated in the laminating direction. The inductor includes multiple internal conductors and multiple via-hole conductors. Each of the internal conductors is disposed on the main surface of a corresponding one of the insulators, and is substantially U-shaped with square corners. Each of the via-hole conductors extends through a corresponding one of the insulators in the laminating direction, and connects, to each other, end portions of two internal conductors adjacent to each other in the laminating direction. Thus, the inductor substantially has a helix shape with the central axis extending in the laminating direction.

SUMMARY

The inventor of the present application has studied a technique for an electronic component including an inductor, such as that in the multilayer electronic component described in Japanese Unexamined Patent Application Publication No. 2007-123726, including multiple inductive conductor layers (internal conductors) disposed on insulator layers. The technique aims at reduction in the length of the inductor in the laminating direction.

It is an object of the present disclosure to provide an electronic component and a method for manufacturing the electronic component which achieve reduction in the length of the inductor in the laminating direction.

According to one aspect of the present disclosure, there is provided an electronic component including a multilayer body and an inductor. The multilayer body has a configuration in which multiple insulator layers are laminated. The inductor includes multiple inductive conductor layers that are disposed on the multiple insulator layers and electrically connected to one another in series. The inductor is substantially helix-shaped in such a manner as to extend helically from one end that is on the lower layer side to the other end that is on the upper layer side. The inductive conductor layers include a first inductive conductor layer and a second inductive conductor layer adjacent to the first inductive conductor layer on the other end side. Each of the first inductive conductor layer and the second inductive conductor layer has a contact portion and a linear portion. The contact portion is, when viewed in the laminating direction, overlapped by an inductive conductor layer adjacent thereto on the one end side or the other end side among the inductive conductor layers. The linear portion is not overlapped by inductive conductor layers adjacent thereto on the one end side and the other end side among the inductive conductor layers. The lower surface of the linear portion of the second inductive conductor layer is positioned higher than the lower surface of the linear portion of the first inductive conductor layer, and is positioned lower than the upper surface of the linear portion of the first inductive conductor layer.

According to another aspect of the present disclosure, there is provided a method for manufacturing an electronic component. The method includes a first process of forming a first insulator layer; a second process of forming a first inductive conductor layer on the first insulator layer, the first inductive conductor layer extending linearly from a first end portion to a second end portion; a third process of forming a second insulator layer on the first insulator layer, the second insulator layer having a thickness less than a thickness of the first inductive conductor layer; and a fourth process of forming a contact portion of a second inductive conductor layer above the second end portion of the first inductive conductor layer and forming a linear portion of the second inductive conductor layer on the second insulator layer in such a manner that the second inductive conductor layer extends linearly from a third end portion formed above the second end portion of the first inductive conductor layer to a fourth end portion on the second insulator layer.

According to the aspects of the present disclosure, reduction in the length of the inductor in the laminating direction may be achieved.

Other features, elements, characteristics and advantages of the present disclosure will become more apparent from the following detailed description of the present disclosure with reference to the attached drawings.

DETAILED DESCRIPTION

An electronic component and a method for manufacturing the electronic component according to an embodiment of the present disclosure will be described below.

Structure of Electronic Component

Figure 1:
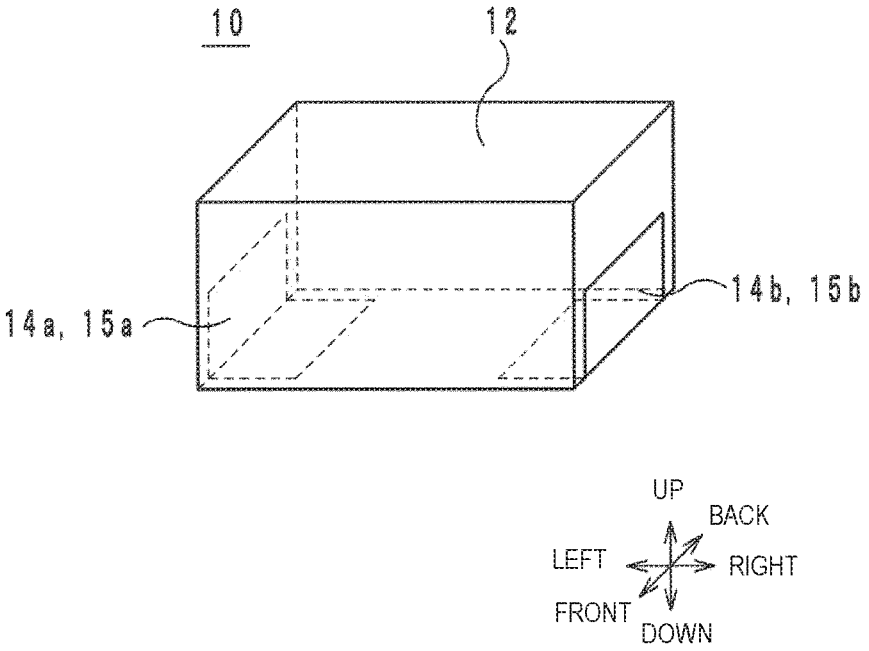
FIG. 1 is an external perspective view of an electronic component.
Figure 2:
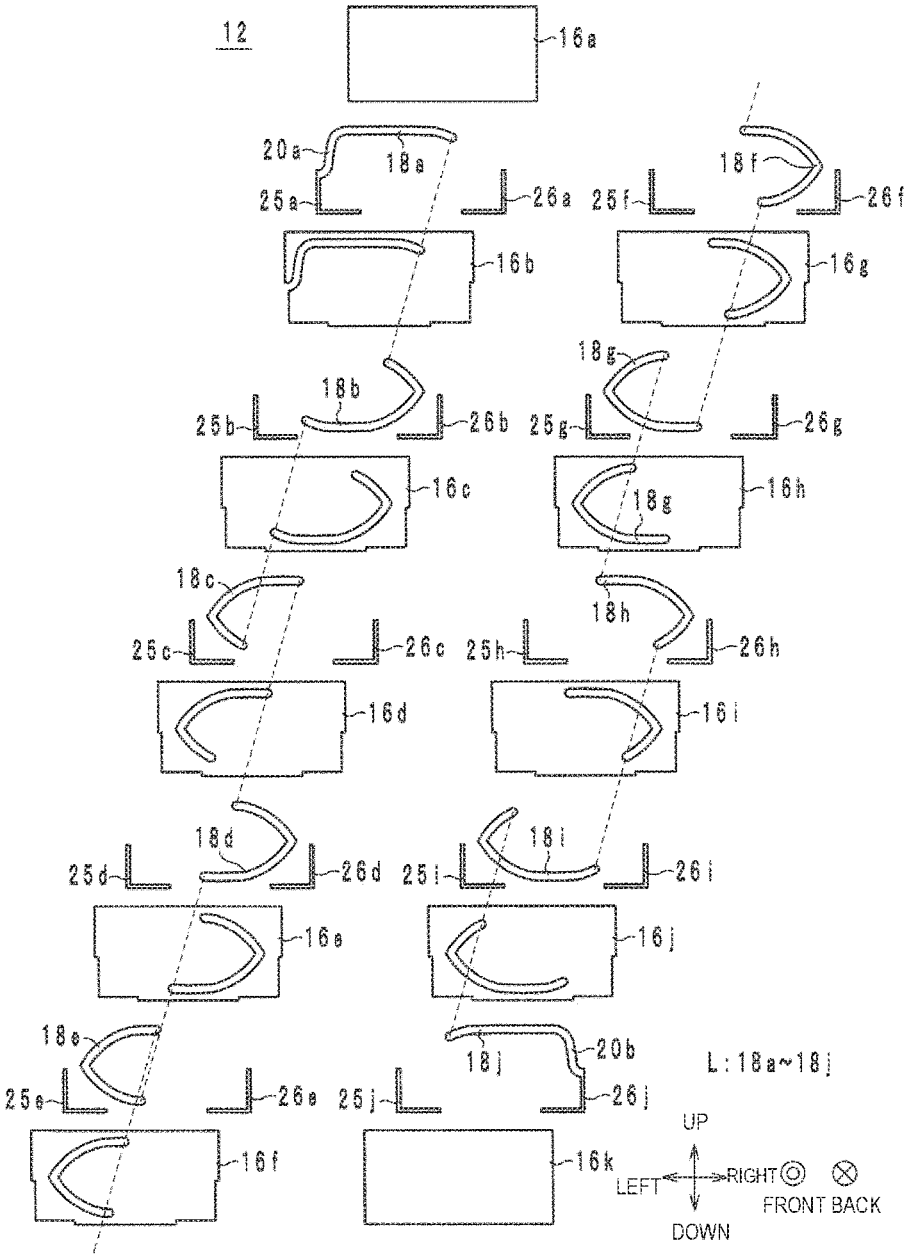
FIG. 2 is an exploded perspective view of a multilayer body of the electronic component in FIG. 1.
Figure 3A:
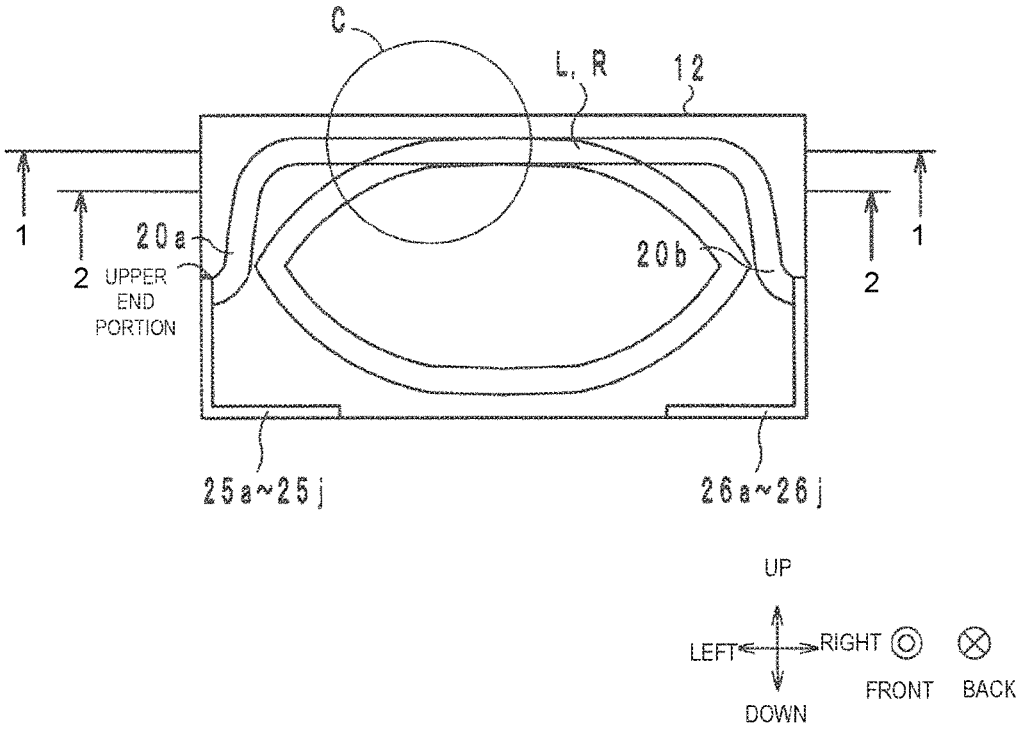
FIG. 3A is a see-through frontal view of the multilayer body.
Figure 3B:
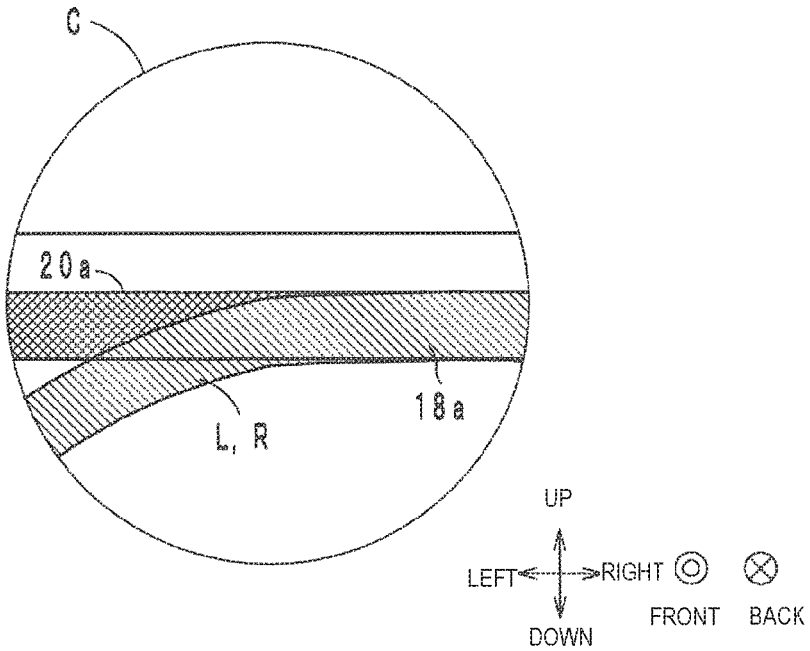
FIG. 3B is an enlarged view of a portion indicated by C in FIG. 3A.
Figure 4A:
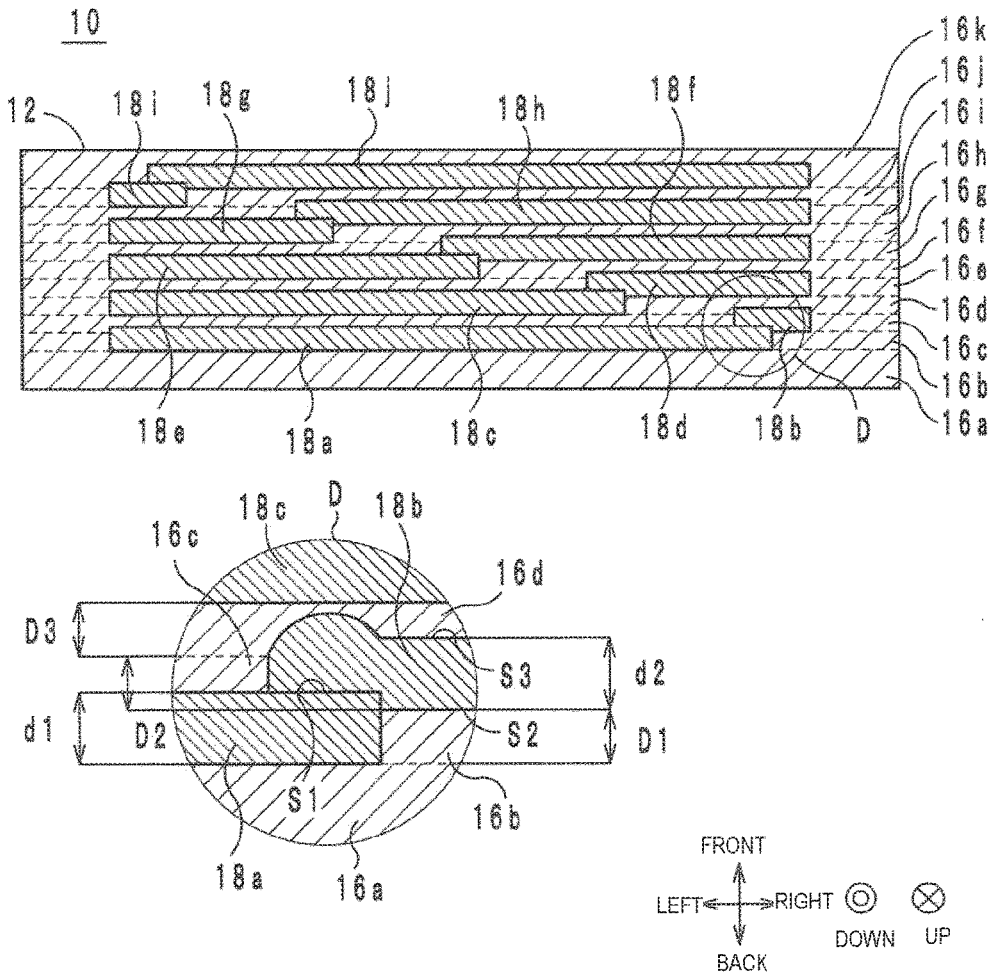
FIG. 4A is a sectional structural view taken along line 1-1 in FIG. 3A.
Figure 4B:
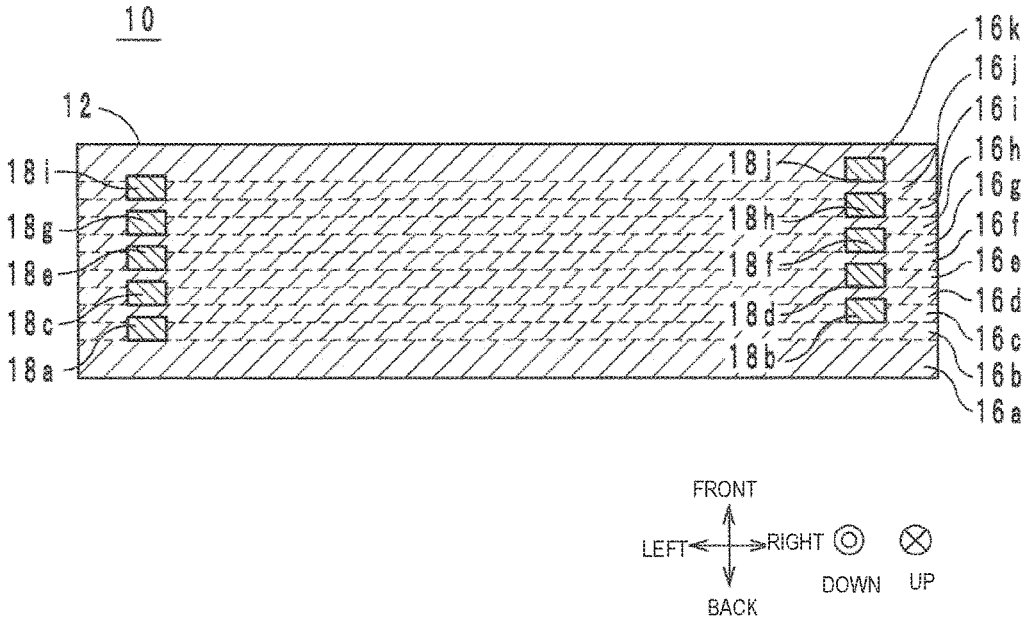
FIG. 4B is a sectional structural view taken along line 2-2 in FIG. 3A.

The structure of an electronic component according to the embodiment will be described below with reference to the drawings. FIG. 1 is an external perspective view of an electronic component 10. FIG. 2 is an exploded perspective view of a multilayer body 12 of the electronic component 10 in FIG. 1. FIG. 3A is a see-through frontal view of the multilayer body 12. FIG. 3B is an enlarged view of a portion indicated by C in FIG. 3A. FIG. 4A is a sectional structural view taken along line 1-1 in FIG. 3A. FIG. 4B is a sectional structural view taken along line 2-2 in FIG. 3A.

In the description below, the laminating direction of the electronic component 10 is defined as the front-back direction. When the electronic component 10 is viewed from the front, the direction in which the long side of the electronic component 10 extends is defined as the left-right direction, and the direction in which the short side of the electronic component 10 extends is defined as the up-down direction. The up-down direction, the left-right direction, and the front-back direction are orthogonal to each other. The up-down direction, the left-right direction, and the front-back direction are an example used for the sake of description. Therefore, when the electronic component 10 is used, the up-down, left-right, and front-back directions of the electronic component 10 do not necessarily match the actual up-down, left-right, and front-back directions.

As illustrated in FIGS. 1 and 2, the electronic component 10 includes the multilayer body 12, outer electrodes 14*a* and 14*b*, lead-out conductor layers 20*a* and 20*b*, and an inductor L. Therefore, the lead-out conductor layers 20*a* and 20*b* are not included in the inductor L.

As illustrated in FIG. 2, the multilayer body 12 has a structure in which substantially-rectangular insulator layers 16*a* to 16*k* (exemplary plurality of insulator layers) are laminated so as to be arranged in this sequence from the back (lower layer side) to the front (upper layer side) in the laminating direction, and substantially has a rectangular parallelepiped shape.

As illustrated in FIG. 2, the insulator layers 16*a* to 16*k* substantially have a rectangular shape having the long side that extends in the left-right direction and the short side that extends in the up-down direction. For example, the insulator layers 16*a* to 16*k* are formed of an insulation material, the main component of which is borosilicate glass. The insulator layers 16*b* to 16*j* substantially have a shape in which the insulation material is not provided in the portions in which outer conductor layers 25*a* to 25*i* and 26*a* to 26*i* and inductive conductor layers 18*a* to 18*i* described below are disposed. That is, the insulator layers 16*b* to 16*j* substantially have a shape in which parts of a rectangle are cut out. In the description below, the surface on the front of each of the insulator layers 16*a* to 16*k* is called a front side surface, and the surface on the back of each of the insulator layers 16*a* to 16*k* is called a backside surface.

The left surface of the multilayer body 12 is formed in such a manner that the left-side short sides of the insulator layers 16*a* to 16*k* are arranged so as to be flush with one another. The right surface of the multilayer body 12 is formed in such a manner that the right-side short sides of the insulator layers 16*a* to 16*k* are arranged so as to be flush with one another. The upper surface of the multilayer body 12 is formed in such a manner that the upper-side long sides of the insulator layers 16*a* to 16*k* are arranged so as to be flush with one another. The lower surface of the multilayer body 12 is formed in such a manner that the lower-side long sides of the insulator layers 16*a* to 16*k* are arranged so as to be flush with one another. The lower surface of the multilayer body 12 serves as a mounting surface of the multilayer body 12. A mounting surface is a surface which faces a circuit substrate when the electronic component 10 is mounted on the circuit substrate and which is parallel to the laminating direction.

The outer electrode 14*a* includes a plating layer 15*a*, the outer conductor layers 25*a* to 25*i*, and an outer conductor layers 25*j*. As illustrated in FIG. 2, the outer conductor layer 25*a* is disposed near the lower left corner of the front side surface of the insulator layer 16*a*. The outer conductor layers 25*a* to 25*i* are disposed in cutout portions provided at the lower left corners of the insulator layers 16*b* to 16*j*, respectively. Therefore, the outer conductor layers 25*a* to 25*i* traverse the insulator layers 16*b* to 16*j* in the front-back direction. The outer conductor layers 25*a* to 25*j* described above substantially have the same shape. When viewed from the front, the outer conductor layers 25*a* to 25*j* substantially have an L shape. Specifically, when viewed from the front, the outer conductor layers 25*a* to 25*j* extend upward from the lower left corner of the multilayer body 12, and extend rightward from the lower left corner of the multilayer body 12. The outer conductor layers 25*a* to 25*j* are superposed on one another in such a manner as to be disposed at the same position when viewed from the front. Accordingly, each of the outer conductor layers 25*a* to 25*j* is connected to an adjacent one(s) in the front-back direction.

The plating layer 15*a* covers a portion in which the outer conductor layers 25*a* to 25*j* are exposed on the left surface and the lower surface of the multilayer body 12. When viewed from the left, the plating layer 15*a* substantially has a rectangular shape. When viewed from the lower side, the plating layer 15*a* substantially has a rectangular shape. The plating layer 15*a* is manufactured by applying Sn plating to Ni plating.

The outer electrode 14*b* includes a plating layer 15*b*, the outer conductor layers 26*a* to 26*i*, and an outer conductor layers 26*j*. As illustrated in FIG. 2, the outer conductor layer 26*a* is disposed near the lower right corner of the front side surface of the insulator layer 16*a*. The outer conductor layers 26*a* to 26*i* are disposed in cutout portions provided at the lower right corners of the insulator layers 16*b* to 16*j*, respectively. Therefore, the outer conductor layers 26*a* to 26*i* traverse the insulator layers 16*b* to 16*j* in the front-back direction. The outer conductor layers 26*a* to 26*j* substantially have the same shape. When viewed from the front, the outer conductor layers 26*a* to 26*j* substantially have an L shape. Specifically, when viewed from the front, the outer conductor layers 26*a* to 26*j* extend upward from the lower right corner of the multilayer body 12, and extend leftward from the lower right corner of the multilayer body 12. The outer conductor layers 26*a* to 26*j* are superposed on one another in such a manner as to be disposed at the same position when viewed from the front. Accordingly, each of the outer conductor layers 26*a* to 26*j* is connected to an adjacent one(s) in the front-back direction.

The plating layer 15*b* covers a portion in which the outer conductor layers 26*a* to 26*j* are exposed on the right surface and the lower surface of the multilayer body 12. When viewed from the right, the plating layer 15*b* substantially has a rectangular shape. When viewed from the lower side, the plating layer 15*b* substantially has a rectangular shape. The plating layer 15*b* is manufactured by applying Sn plating to Ni plating. The plating layers 15*a* and 15*b* may be formed of a material having properties, such as low electrical resistance, high solder resistance, and high wettability. Examples of such a material include, Sn, Ni, Cu, Au, and an alloy containing these.

The inductor L which is electrically connected to the outer electrodes 14*a* and 14*b* includes the inductive conductor layers 18*a* to 18*j* (exemplary plurality of inductive conductor layers) which are electrically connected in series in this sequence. The inductor L is a helical coil having the central axis extending in the front-back direction. In the present embodiment, the inductor L substantially has a helix shape in which the inductor L extends from the back (lower layer side) to the front (upper layer side) while going around clockwise when viewed from the front. A helix shape means a shape where a line winds round in the third-dimensional structure. The diameter of the inductor L is substantially uniform, and is substantially the same at any position in the front-back direction. Therefore, when viewed from the front, as illustrated in FIG. 3A, the inductor L goes around along a track R that substantially has a hexagonal circular shape having rounded corners. However, when viewed from the front, the inductor L (track R) is not overlapped by the outer electrodes 14*a* and 14*b*.

The inductive conductor layers 18*a* to 18*j* are disposed on the front side surfaces of the insulator layers 16*a* to 16*j*, respectively, (that is, on the insulator layers 16*a* to 16*j*). The inductive conductor layers 18*a* to 18*j* are linear conductive layers that substantially have a shape obtained by cutting out a part of the track R. Thus, the inductive conductor layers 18*a* to 18*j* are arranged in this sequence from the back to the front, and are electrically connected in series in this sequence. The thicknesses of the inductive conductor layers 18*a* to 18*j* in the front-back direction are substantially the same.

When viewed from the front, the inductive conductor layers 18*a* to 18*j* are overlapped, thus forming the track R. The inductive conductor layers 18*a* to 18*j* are manufactured, for example, by using a conductive material, the main component of which is Ag. By taking the inductive conductor layers 18*a* and 18*b* as an example, the inductive conductor layers 18*a* to 18*j* will be described in more detail below.

The inductive conductor layer 18*a* (exemplary first inductive conductor layer) is disposed on the front side surface of the insulator layer 16*a* (exemplary first insulator layer), and has a length less than the length of one turn of the inductor L. The length of one turn of the inductor L is the length of the track R. The length of the inductive conductor layer 18*a* indicates the line length of the linear inductive conductor layer 18*a*.

The insulator layer 16*b* (exemplary second insulator layer) is disposed on the front side surface of the insulator layer 16*a*. The insulator layer 16*b* is provided with a cutout portion that substantially has the same shape as that of the inductive conductor layer 18*a*. Accordingly, the inductive conductor layer 18*a* is disposed in the cutout portion of the insulator layer 16*b*. However, as illustrated in FIG. 4A, the thickness (hereinafter simply referred to as the insulator layer thickness) D1 of the insulator layer 16*b* in the front-back direction is less than the thickness (hereinafter simply referred to as the inductive conductor layer thickness) d1 of the inductive conductor layer 18*a* in the front-back direction. Therefore, the inductive conductor layer 18*a* protrudes forward from the front side surface of the insulator layer 16*b*. That is, the inductive conductor layer 18*a* is not covered by the insulator layer 16*b*.

The inductive conductor layer 18*b* (exemplary second inductive conductor layer) which is adjacent to the inductive conductor layer 18*a* on the front (exemplary upper layer side) and which is disposed on the front side surface of the insulator layer 16*b* has a length less than the length of one turn of the inductor L. The inductive conductor layer 18*a* includes a contact portion that, when viewed from the front (in the laminating direction), is overlapped by the inductive conductor layer 18*b* which is adjacent thereto on the upper layer side, and a linear portion that is not overlapped by the inductive conductor layer 18*b*. The inductive conductor layer 18*b* includes a contact portion that, when viewed from the front, is overlapped by the inductive conductor layer 18*a* which is adjacent thereto on the lower layer side, a contact portion that is overlapped by the inductive conductor layer 18*c* adjacent thereto on the upper layer side, and a linear portion which is not overlapped by the inductive conductor layers 18*a* and 18*c*. Thus, the upper surface S1 of the contact portion of the inductive conductor layer 18*a* is directly in contact with the lower surface S2 of the contact portion of the inductive conductor layer 18*b*. The upper surface S3 of the contact portion of the inductive conductor layer 18*b* protrudes forward from the linear portion of the inductive conductor layer 18*b* as illustrated in the enlarged view in FIG. 4A. However, in the sectional structural view of the entire electronic component 10 in FIG. 4A, to avoid the drawing becoming complicated, the state in which the upstream contact portion of the inductive conductor layer 18*b* extending in the clockwise direction protrudes forward from the linear portion of the inductive conductor layer 18*b* is not illustrated. The structure described above allows the inductive conductor layer 18*a* to be electrically connected to the inductive conductor layer 18*b* in series.

The sum of the length of the inductive conductor layer 18*a* and that of the inductive conductor layer 18*b* is less than the length of one turn of the inductor L. Thus, when viewed from the front, a downstream end portion of the inductive conductor layer 18*b* is not overlapped by the inductive conductor layer 18*a*. This structure achieves avoidance of a short circuit which occurs due to contact between an upstream end portion of the inductive conductor layer 18*a* extending in the clockwise direction and the downstream end portion of the inductive conductor layer 18*b* extending in the clockwise direction.

The insulator layer 16*c* (exemplary third insulator layer) is disposed on the front side surface of the insulator layer 16*b*. The thickness D2 of the insulator layer 16*c* is less than the thickness d2 of the linear portion of the inductive conductor layer 18*b*. Therefore, the inductive conductor layer 18*b* protrudes forward from the front side surface of the insulator layer 16*c*. That is, the inductive conductor layer 18*b* is not covered by the insulator layer 16*c*. The sum of the thickness D1 of the insulator layer 16*b* and the thickness D2 of the insulator layer 16*c* is more than the thickness d1 of the inductive conductor layer 18*a*. Thus, the inductive conductor layer 18*a* is covered by the insulator layer 16*c*.

As described above, as illustrated in FIGS. 4A and 4B, the inductive conductor layer 18*a* is disposed on the front side surface of the insulator layer 16*a*, and the linear portion of the inductive conductor layer 18*b* is disposed on the front side surface of the insulator layer 16*b*. The thickness D1 of the insulator layer 16*b* is less than the thickness d1 of the linear portion of the inductive conductor layer 18*a*. Therefore, the upper surface S1 of the inductive conductor layer 18*a* is positioned forward from the lower surface S2 of the linear portion of the inductive conductor layer 18*b*. The upper surface S1 of the inductive conductor layer 18*a* is positioned backward from the upper surface S3 of the inductive conductor layer 18*b*. Thus, the lower surface S2 of the linear portion of the inductive conductor layer 18*b* is higher than the lower surface of the linear portion of the inductive conductor layer 18*a*, and is lower than the upper surface S1 of the linear portion of the inductive conductor layer 18*a*.

Any two inductive conductor layers adjacent to each other in the front-back direction (from the lower layer side to the upper layer side) among the inductive conductor layers 18*a* to 18*j* satisfy the same relationship as that between the inductive conductor layer 18*a* (exemplary first inductive conductor layer) and the inductive conductor layer 18*b* (exemplary second inductive conductor layer). For example, the inductive conductor layer 18*b* and the inductive conductor layer 18*c* adjacent on the front of the inductive conductor layer 18*b* satisfy the same relationship as that between the inductive conductor layer 18*a* and the inductive conductor layer 18*b*. That is, in the relationship between the inductive conductor layer 18*b* and the inductive conductor layer 18*c*, the inductive conductor layer 18*b* serves as an exemplary first inductive conductor layer, and the inductive conductor layer 18*c* serves as an exemplary second inductive conductor layer. In this case, as illustrated in FIGS. 4A and 4B, the insulator layer 16*c* and the linear portion of the inductive conductor layer 18*b* are disposed on the front side surface of the insulator layer 16*b*. The thickness of the insulator layer 16*c* (exemplary third insulator layer) is less than that of the linear portion of the inductive conductor layer 18*b*. The sum of the thickness of the insulator layer 16*c* and that of the insulator layer 16*d* is more than the thickness of the inductive conductor layer 18*b*.

The relationship between the inductive conductor layer 18*c* and the inductive conductor layer 18*d* and the other relationships are the same as that between the inductive conductor layer 18*b* and the inductive conductor layer 18*c*.

The lead-out conductor layer 20*a* is a linear conductive layer disposed on the front side surface of the insulator layer 16*a*. The lead-out conductor layer 20*a* connects, to the outer conductor layer 25*a*, the upstream end portion of the inductive conductor layer 18*a* extending in the clockwise direction. The lead-out conductor layer 20*b* is a linear conductive layer disposed on the front side surface of the insulator layer 16*j*. The lead-out conductor layer 20*b* connects a downstream end portion of the inductive conductor layer 18*j* to the outer conductor layer 26*j*. Thus, the inductor L is electrically connected between the outer electrode 14*a* and the outer electrode 14*b*. The lead-out conductor layers 20*a* and 20*b* are manufactured, for example, by using a conductive material, the main component of which is Ag.

Borders between the inductive conductor layers 18*a* and 18*j* and the lead-out conductor layers 20*a* and 20*b*, and borders between the outer conductor layers 25*a* and 26*j* and the lead-out conductor layers 20*a* and 20*b* will be described. The description will be made below with reference to FIG. 3B by taking the lead-out conductor layer 20*a* as an example.

A portion positioned on the track R indicates the inductive conductor layer 18*a*, and a conductive layer which is not positioned on the track R is not the inductive conductor layer 18*a*. Therefore, the border between the inductive conductor layer 18*a* and the lead-out conductor layer 20*a* is a portion in which the lead-out conductor layer 20*a* is in contact with the track R.

As illustrated in FIG. 3A, an upper end portion of the outer conductor layer 25*a* extends in the left-right direction. Therefore, a portion disposed downward from the upper end portion extending in the left-right direction is the outer conductor layer 25*a*, and a portion disposed rightward from the upper end portion is the lead-out conductor layer 20*a*.

Method for Manufacturing Electronic Component

A method for manufacturing the electronic component 10 according to the present embodiment will be described below with reference to the drawings. FIGS. 5A to 5C and FIGS. 6A to 6C are sectional views denoting steps for manufacturing the electronic component 10. In FIGS. 5A to 5C and FIGS. 6A to 6C, sectional structural views taken along line 1-1 in FIG. 3A are illustrated in the left half, and sectional structural views taken along line 2-2 in FIG. 3A are illustrated in the right half. FIGS. 7A to 7C and FIGS. 8A to 8C are frontal views of the electronic component 10 being manufactured.

First, a mother insulating layer 116*a* which is to become multiple insulator layers 16*a* is formed (exemplary first process). A mother insulating layer is a large-format insulator layer in which portions, each of which is to become one of the insulator layers 16*a* to 16*k*, are arranged in a matrix in such a manner as to be connected to one another. After an insulating paste, the main component of which is borosilicate glass, is applied to a carrier film, the entire insulating paste is exposed to ultraviolet light. Thus, the insulating paste is solidified, and the mother insulating layer 116*a* is formed.

Figure 5A:
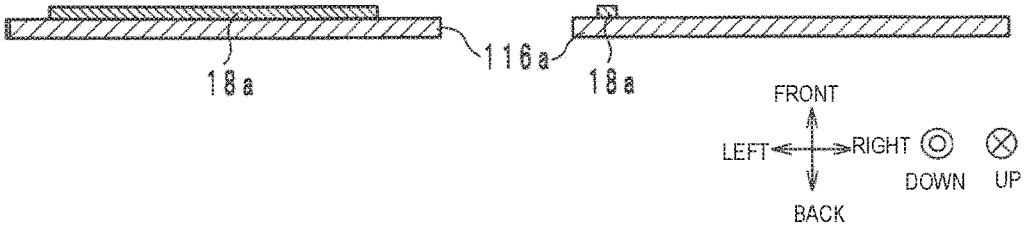
FIG. 5A is a sectional view denoting a step for manufacturing the electronic component.
Figure 7A:
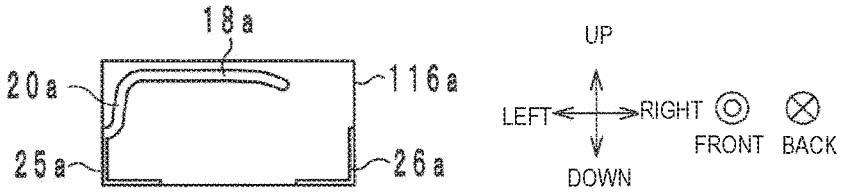
FIG. 7A is a frontal view of the electronic component being manufactured.

Then, as illustrated in FIGS. 5A and 7A, the inductive conductor layer 18*a*, the lead-out conductor layer 20*a*, and the outer conductor layers 25*a* and 26*a* are formed on each portion of the mother insulating layer 116*a*, which is to become an insulator layer 16*a*, through photolithography processing (exemplary second process). Specifically, a photosensitive conductive paste, the metal base of which is Ag, is applied, and a conductive paste layer is formed on the mother insulating layer 116*a*. Further, ultraviolet light or the like is irradiated onto the conductive paste layer through a photomask, and developing is performed by using an alkaline solution or the like. Thus, the inductive conductor layer 18*a*, the lead-out conductor layer 20*a*, and the outer conductor layers 25*a* and 26*a* are formed on each portion of the mother insulating layer 116*a*. At this time, the inductive conductor layer 18*a* extending linearly in the clockwise direction is formed from the upstream end portion (exemplary first end portion) thereof to a downstream end portion (exemplary second end portion) thereof.

Figure 5B:
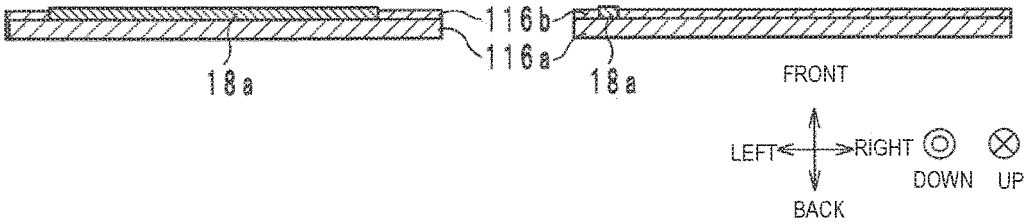
FIG. 5B is a sectional view denoting a step for manufacturing the electronic component.
Figure 7B:
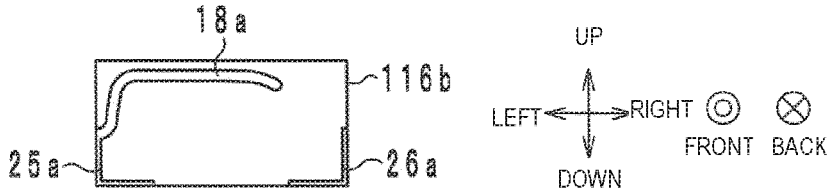
FIG. 7B is a frontal view of the electronic component being manufactured.

As illustrated in FIGS. 5B and 7B, a mother insulating layer 116*b* which is to become multiple insulator layers 16*b* is formed (exemplary third process). After the insulating paste, the main component of which is borosilicate glass, is applied to the mother insulating layer 116*a*, the insulating paste is exposed to ultraviolet light through a photomask covering the inductive conductor layer 18*a*, the lead-out conductor layer 20*a*, and the outer conductor layers 25*a* and 26*a* which are disposed on each portion. Thus, the insulating paste in portions other than those covered by the photomask is solidified. Then, the insulating paste that has not been solidified is removed by using the alkaline solution or the like. In this step, the thickness of the applied insulating paste is less than that of the inductive conductor layer 18*a*, the lead-out conductor layer 20*a*, and the outer conductor layers 25*a* and 26*a*. Thus, each portion that is to become an insulator layer 16*b* and that has a thickness D1 less than the thickness d1 of the inductive conductor layer 18*a* is formed on a corresponding one of the portions that are to become the insulator layers 16*a*. As a result, the mother insulating layer 116*b* that does not cover the inductive conductor layer 18*a*, the lead-out conductor layer 20*a*, and the outer conductor layers 25*a* and 26*a* in each portion is formed. The inductive conductor layer 18*a*, the lead-out conductor layer 20*a*, and the outer conductor layers 25*a* and 26*a* in each portion protrude forward from the mother insulating layer 116*b*.

Figure 5C:
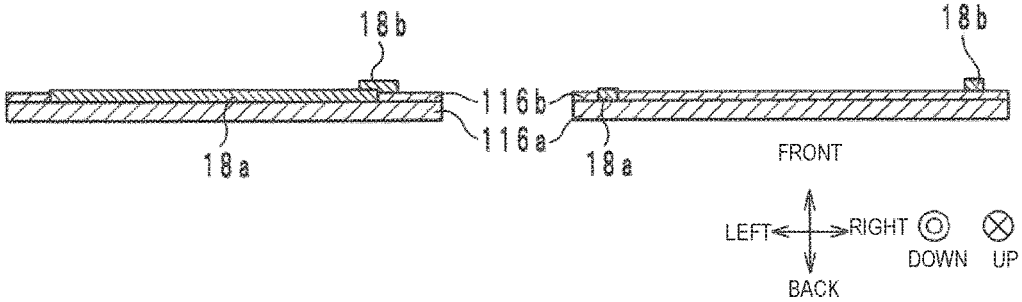
FIG. 5C is a sectional view denoting a step for manufacturing the electronic component.
Figure 7C:
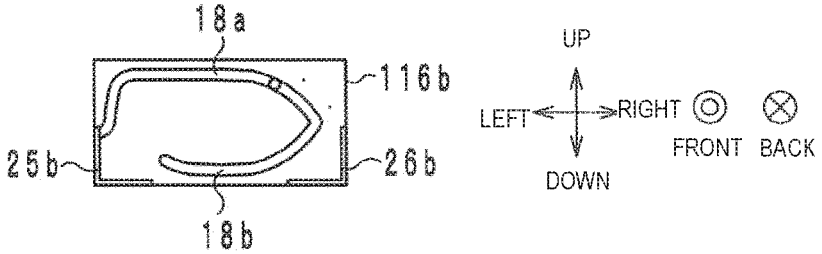
FIG. 7C is a frontal view of the electronic component being manufactured.

As illustrated in FIGS. 5C and 7C, the inductive conductor layer 18*b* which is connected to the inductive conductor layer 18*a* in series and the outer conductor layers 25*b* and 26*b* are formed on each portion of the mother insulating layer 116*b* through photolithography processing (exemplary fourth process). Specifically, the photosensitive conductive paste, the metal base of which is Ag, is applied, and a conductive paste layer is formed on the mother insulating layer 116*b*. Further, ultraviolet light or the like is irradiated onto the conductive paste layer through a photomask, and developing is performed by using the alkaline solution or the like. Thus, the inductive conductor layer 18*b* and the outer conductor layers 25*b* and 26*b* are formed on each portion of the mother insulating layer 116*b*. At this time, an upstream end portion (exemplary third end portion) of the inductive conductor layer 18*b* extending in the clockwise direction is formed on the downstream end portion (exemplary second end portion) of the inductive conductor layer 18*a* extending in the clockwise direction, and the inductive conductor layer 18*b* is formed linearly from the end portion thereof on each portion of the mother insulating layer 116*b* which is to become an insulator layer 16*b*. Thus, the upstream contact portion of the inductive conductor layer 18*b* extending in the clockwise direction is formed on the downstream end portion of the inductive conductor layer 18*a* extending in the clockwise direction, and a linear portion of the inductive conductor layer 18*b* is formed on each portion that is to become an insulator layer 16*b*. Thus, the inductive conductor layer 18*b* adjacent to the inductive conductor layer 18*a* on the upper layer side is formed.

Figure 6A:
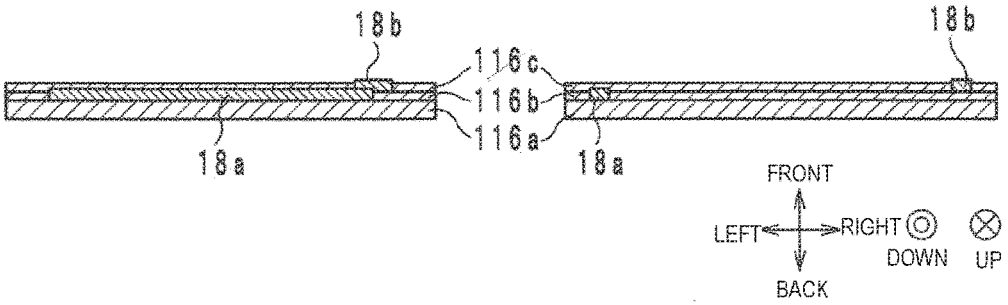
FIG. 6A is a sectional view denoting a step for manufacturing the electronic component.
Figure 8A:
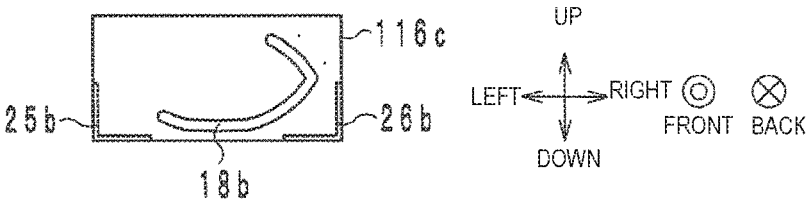
FIG. 8A is a frontal view of the electronic component being manufactured.

As illustrated in FIGS. 6A and 8A, a mother insulating layer 116*c* which is to become multiple insulator layers 16*c* is formed (exemplary fifth process). After the insulating paste, the main component of which is borosilicate glass, is applied to the mother insulating layer 116*b*, and the insulating paste is exposed to ultraviolet light through a photomask covering the inductive conductor layer 18*b* and the outer conductor layers 25*b* and 26*b* which are disposed on each portion. Thus, the insulating paste in portions other than those covered by the photomask is solidified. Then, the insulating paste that has not been solidified is removed by using the alkaline solution or the like. In this step, the thickness of the applied insulating paste is less than that of the inductive conductor layer 18*b* and the outer conductor layers 25*b* and 26*b*. Thus, each portion that is to become an insulator layer 16*c* having the thickness D1 less than the thickness d1 of the inductive conductor layer 18*b* is formed on a corresponding one of the portions that are to become the insulator layers 16*b*. Further, the sum of the thickness D1 of the mother insulating layer 116*b* and the thickness D2 of the mother insulating layer 116*c* is more than the thickness d1 of the inductive conductor layer 18*a*. Thus, the mother insulating layer 116*c* which covers the inductive conductor layer 18*a* in each portion and which does not cover the inductive conductor layer 18*b* and the outer conductor layers 25*b* and 26*b* in the portion is formed. The inductive conductor layer 18*b* and the outer conductor layers 25*b* and 26*b* in each portion protrude forward from the mother insulating layer 116*c*.

Figure 6B:
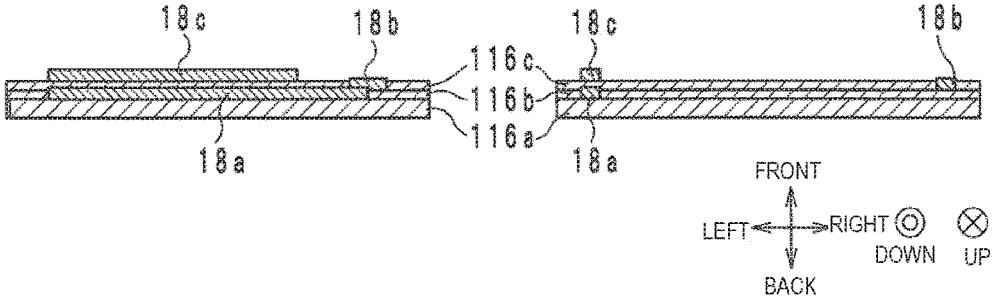
FIG. 6B is a sectional view denoting a step for manufacturing the electronic component.
Figure 8B:
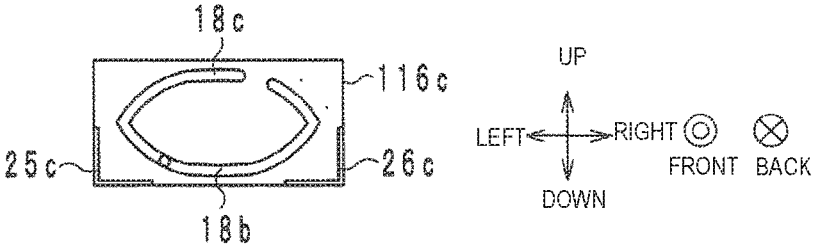
FIG. 8B is a frontal view of the electronic component being manufactured.

As illustrated in FIGS. 6B and 8B, the inductive conductor layer 18*c* (exemplary third inductive conductor layer) connected to the inductive conductor layer 18*b* in series and the outer conductor layers 25*c* and 26*c* are formed on each portion of the mother insulating layer 116*c* through photolithography processing (exemplary sixth process). Specifically, the photosensitive conductive paste, the metal base of which is Ag, is applied, and a conductive paste layer is formed on the mother insulating layer 116*c*. Further, ultraviolet light or the like is irradiated onto the conductive paste layer through a photomask, and developing is performed with the alkaline solution or the like. Thus, the inductive conductor layer 18*c* and the outer conductor layers 25*c* and 26*c* are formed on each portion of the mother insulating layer 116*c*. At this time, an upstream end portion (exemplary fifth end portion) of the inductive conductor layer 18*c* extending in the clockwise direction is formed on the downstream end portion (exemplary fourth end portion) of the inductive conductor layer 18*b* extending in the clockwise direction, and the linear inductive conductor layer 18*c* is formed from the end portion thereof on each portion of the mother insulating layer 116*c* which is to become an insulator layer 16*c*. Thus, an upstream contact portion of the inductive conductor layer 18*c* extending in the clockwise direction is formed on the downstream end portion of the inductive conductor layer 18*b* extending in the clockwise direction, and a linear portion of the inductive conductor layer 18*c* is formed on each portion that is to become an insulator layer 16*c*. Thus, the inductive conductor layer 18*c* adjacent to the inductive conductor layer 18*b* on the upper layer side is formed.

Figure 6C:
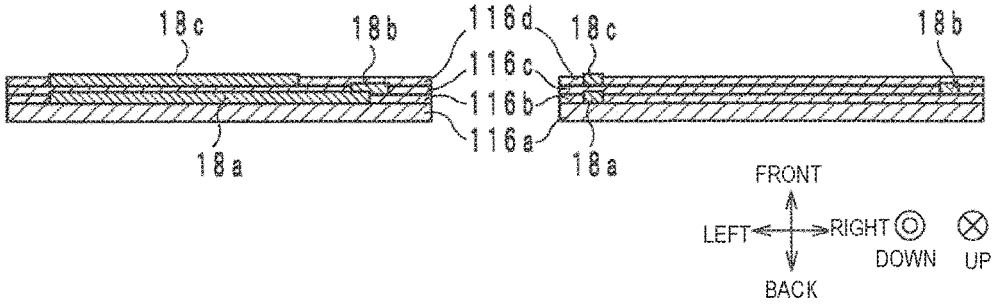
FIG. 6C is a sectional view denoting a step for manufacturing the electronic component.
Figure 8C:
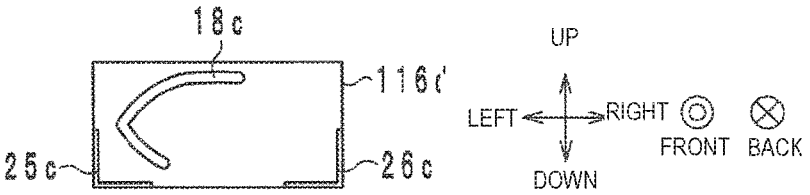
FIG. 8C is a frontal view of the electronic component being manufactured.

As illustrated in FIGS. 6C and 8C, a mother insulating layer 116*d* that is to become multiple insulator layers 16*d* is formed. After the insulating paste, the main component of which is borosilicate glass, is applied to the mother insulating layer 116*c*, the insulating paste is exposed to ultraviolet light through a photomask covering the inductive conductor layer 18*c* and the outer conductor layers 25*c* and 26*c* which are disposed on each portion. Thus, the insulating paste in portions other than those covered by the photomask is solidified. Then, the insulating paste that has not been solidified is removed by using the alkaline solution or the like. In this step, the thickness of the mother insulating layer 116*d* is less than that of the inductive conductor layer 18*c*.

Further, the sum of the thickness of the mother insulating layer 116*c* and that of the mother insulating layer 116*d* is more than the thickness of the inductive conductor layer 18*b*. Thus, the mother insulating layer 116*d* which covers the inductive conductor layer 18*b* in each portion and which does not cover the inductive conductor layer 18*c* and the outer conductor layers 25*c* and 26*c* in each portion is formed. The inductive conductor layer 18*c* and the outer conductor layers 25*c* and 26*c* in each portion protrude forward from the mother insulating layer 116*d*.

Then, the processes (exemplary second to fifth processes) in FIGS. 5A to 5C and 6A are repeatedly performed multiple times. Thus, mother insulating layers 116*e* to 116*j* that are to become multiple insulator layers 16*e* to 16*j* are formed, and inductive conductor layers 18*d* to 18*j*, lead-out conductor layer 20*b*, and outer conductor layers 25*d* to 25*j* and 26*d* to 26*j* are also formed.

A mother insulating layer 116*k* that is to become multiple insulator layers 16*k* is formed. The mother insulating layer 116*k* is formed in the same manner as the mother insulating layer 116*a*, and formation of the mother insulating layer 116*k* will not be described. Through the above-described processes, a mother multilayer body in which multiple multilayer bodies 12 are arranged in a matrix in such a manner as to be connected to one another is obtained.

The mother multilayer body is cut into multiple multilayer bodies 12 that have not been fired, through a cutting operation with a dicing machine or the like. In the process of cutting a mother multilayer body, the outer conductor layers 25*a* to 25*j* and 26*a* to 26*j* are exposed on each multilayer body 12 on cut surfaces formed by the cutting process. In the firing process described below, the multilayer bodies 12 are shrunk. Therefore the mother multilayer body is cut in consideration of the shrinking.

Then, the multilayer bodies 12 that have not been fired are fired in a given condition. Thus, the multilayer bodies 12 are obtained. Further, barrel finishing is performed on the multilayer bodies 12.

Finally, portions in which the outer conductor layers 25*a* to 25*j* and 26*a* to 26*j* are exposed on each multilayer body 12 are subjected to application of Ni plating with a thickness that is substantially equal to or more than 2 μm and equal to or less than 10 μm and application of Sn plating with a thickness that is substantially equal to or more than 2 μm and equal to or less than 10 μm. Through the above-described processes, the electronic components 10 are completed. The size of an electronic component 10 is, for example, about 0.4 mm×0.2 mm×0.2 mm.

An electronic component 10 may be manufactured by using a sheet laminating method in which a multilayer body that has not been fired is formed by stacking, on top of another, one ceramic green sheet provided with a conductor layer and performing pressure bonding, and in which the multilayer body that has not been fired is then fired.

Effects

An electronic component 10 having such a structure enables the length of the inductor L in the front-back direction (laminating direction) to be shortened. More specifically, the lower surface S2 of the linear portion of the inductive conductor layer 18*b* is positioned higher than the lower surface of the linear portion of the inductive conductor layer 18*a*, and is positioned lower than the upper surface S1 of the linear portion of the inductive conductor layer 18*a*. Thus, the space between the inductive conductor layer 18*a* and the inductive conductor layer 18*b* which are adjacent to each other in the front-back direction may be made small. In the electronic component 10, any two inductive conductor layers adjacent to each other in the front-back direction among the inductive conductor layers 18*b* to 18*j* satisfy the same relationship as that between the inductive conductor layer 18*a* and the inductive conductor layer 18*b*. Therefore, among the inductive conductor layers 18*b* to 18*j*, the space between any two inductive conductor layers adjacent to each other in the front-back direction may be also made small. Accordingly, the length of the inductor L in the front-back direction may be made small.

Figure 9A:
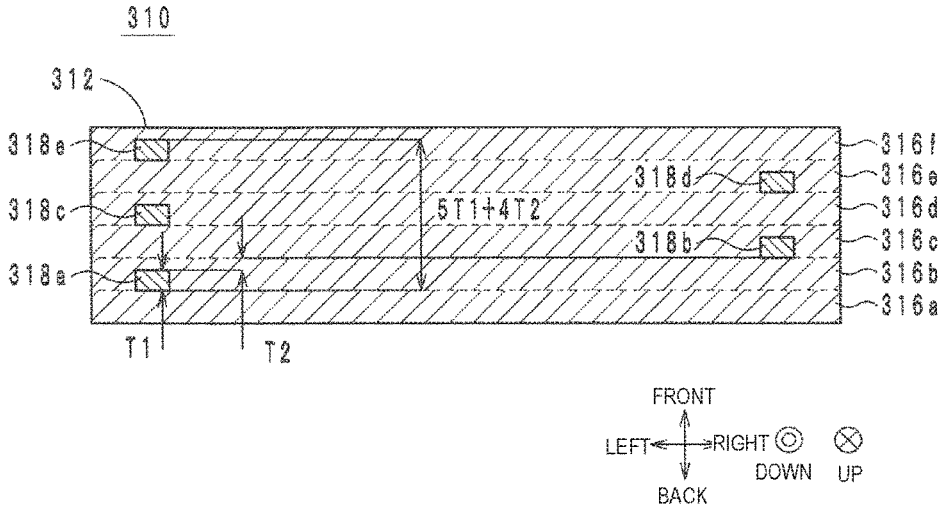
FIG. 9A is a sectional structural view of an electronic component according to a comparative example.
Figure 9B:
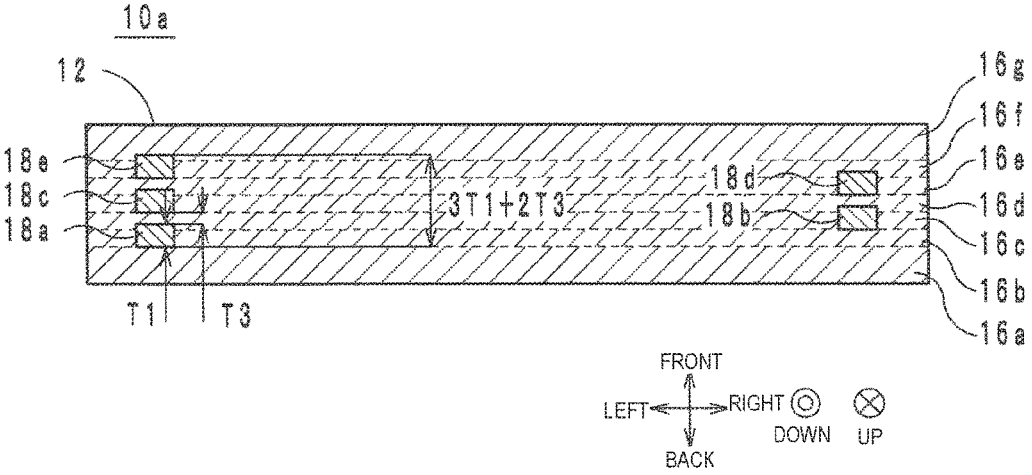
FIG. 9B is a sectional structural view of an electronic component according to an exemplary embodiment.

The electronic component 10 achieves a larger inductance value of the inductor L as described above. An exemplary electronic component 310 according to a comparative example will be described below. FIG. 9A is a sectional structural view of the electronic component 310 according to the comparative example. For the structure of the electronic component 310 which is the same as that of the electronic component 10, reference numerals obtained by adding 300 to reference numerals of the electronic component 10 are used. FIG. 9B is a sectional structural view of an electronic component 10*a* according to an exemplary embodiment.

The structure of the electronic component 310 according to the comparative example will be described. In the electronic component 310, layers adjacent to each other in the front-back direction among inductive conductor layers 318*a* to 318*e* are not overlapped when viewed in the up-down direction or the left-right direction. That is, it has a structure similar to that of the multilayer electronic component described in Japanese Unexamined Patent Application Publication No. 2007-123726. However, the inductive conductor layers 318*a* to 318*e* have the same lengths as those of the inductive conductor layers 18*a* to 18*e*, respectively, of the electronic component 10*a* according to the exemplary embodiment. Therefore, the number of turns of the inductor L of the electronic component 310 is the same as that of the electronic component 10*a* according to the exemplary embodiment. The thickness of each of the inductive conductor layers 318*a* to 318*e* is set to a thickness T1. The space between layers adjacent to each other in the front-back direction among the inductive conductor layers 318*a* to 318*e* is set to a space T2. In this case, the length of the inductor L of the electronic component 310 in the front-back direction is 5T1+4T2.

The structure of the electronic component 10*a* according to the exemplary embodiment will be described. The thickness of each of the inductive conductor layers 18*a* to 18*e* is set to the thickness T1, and the space between the inductive conductor layer 18*a* and the inductive conductor layer 18*c*, the space between the inductive conductor layer 18*b* and the inductive conductor layer 18*d*, and the space between the inductive conductor layer 18*c* and the inductive conductor layer 18*e* are set to a space T3. When the electronic component 10 and the electronic component 310 are formed in the same condition (same process rule), the lowest value of the insulator layer thickness of the electronic component 10 in a portion covering an inductive conductor layer is equivalent to that of the electronic component 310. Therefore, assume that the space T2 is equal to the space T3. In this case, the length of the inductor L of the electronic component 10 in the front-back direction is 3T1+2T3 (=3T1+2T2).

A relation of $L=\mu N^2S/l$ (L: inductance value, μ: permeability, N: the number of turns, S: cross-sectional area, l: the length of the inductor in the front-back direction) holds. The inductor L of the electronic component 10 is substantially the same as that of the electronic component 310 except for the length of the inductor L in the front-back direction. Further, the length 3T1+2T3 of the inductor L of the electronic component 10 in the front-back direction is less than the length 5T1+4T2 of the inductor L of the electronic component 310 in the front-back direction. Therefore, the inductance value of the electronic component 10 is more than that of the electronic component 310.

Accordingly, the electronic component 10 achieves an inductance value equivalent to that of the electronic component 310 even when the number N of turns of the inductor L is reduced. Reduction in the number N of turns of the inductor L makes the line length (current path length) of the inductor L small. Therefore, the resistance value of the inductor L is reduced. Accordingly, the electronic component 10 having a resistance value less than that of the inductor L of the electronic component 310 achieves an inductance value equivalent to that of the electronic component 310. As a result, the electronic component 10 achieves an improved Q value.

To shorten the length of the inductor L in the front-back direction (laminating direction), the electronic component 10 has a structure in which the lower surface S2 of the linear portion of the inductive conductor layer 18*b* is positioned higher than the lower surface of the linear portion of the inductive conductor layer 18*a*, and is positioned lower than the upper surface S1 of the linear portion of the inductive conductor layer 18*a*. To achieve such a structure, in the electronic component 10 and the method for manufacturing the electronic component 10, the inductive conductor layer 18*a* is disposed on the front side surface of the insulator layer 16*a*, and the inductive conductor layer 18*b* is disposed on the front side surface of the insulator layer 16*b*. Further, the thickness of the insulator layer 16*b* is less than that of the inductive conductor layer 18*a*. However, another structure may be implemented in which a portion of the inductive conductor layer 18*a* is superposed on a portion of the inductive conductor layer 18*b* when viewed in the up-down or left-right direction.

As illustrated in FIG. 4A, in the electronic component 10 and the method of manufacturing the electronic component 10, the insulator layer 16*c* is disposed on the front side surface of the insulator layer 16*b*. The thickness D2 of the insulator layer 16*c* is less than the thickness d2 of the inductive conductor layer 18*b*. Therefore, the inductive conductor layer 18*b* protrudes forward from the front side surface of the insulator layer 16*c*. However, the sum of the thickness D1 of the insulator layer 16*b* and the thickness D2 of the insulator layer 16*c* is more than the thickness d1 of the inductive conductor layer 18*a*. Thus, the inductive conductor layer 18*a* is covered by the insulator layer 16*c*. The structure of insulator layer 16*c* causes a state in which, when the inductive conductor layer 18*c* is formed on the front side surface of the insulator layer 16*c*, the inductive conductor layer 18*a* is insulated from the inductive conductor layer 18*c* while the inductive conductor layer 18*b* is electrically connected to the inductive conductor layer 18*c* in series. Further, a portion of the inductive conductor layer 18*b* is superposed on a portion of the inductive conductor layer 18*c* when viewed in the up-down or left-right direction. However, the sum of the thickness D1 and the thickness D2 is not necessarily more than the thickness d1. For example, when the inductive conductor layers 18*a*, 18*b* and 18*c* form one turn (when extending back to the starting position after one turn), any structure may be employed as long as the sum of the thicknesses of the insulator layers 16*b*, 16*c*, and 16*d* is more than the thickness d1.

In the electronic component 10 and the method of manufacturing the electronic component 10, via-hole conductors are not necessary in implementation of the inductor L. A description will be made below by taking connection between the inductive conductor layer 18*a* and the inductive conductor layer 18*b* as an example. In a typical electronic component, a via-hole conductor that extends through an insulator layer in the laminating direction is disposed to connect two inductive conductor layers to each other. In contrast, in the electronic component 10, the upper surface S1 of the downstream contact portion of the inductive conductor layer 18*a* extending in the clockwise direction is directly in contact with the lower surface S2 of the upstream contact portion of the inductive conductor layer 18*b* extending in the clockwise direction. That is, the inductive conductor layer 18*a* is connected to the inductive conductor layer 18*b* without an inductive conductor layer in between. Thus, in the electronic component 10, via-hole conductors are not necessary in implementation of the inductor L.

When via-hole conductors are not necessary as described above, the Q value of the inductor L is improved. More specifically, via-hole conductors do not contribute to the number of turns of an inductor, and contributes to the line length of the inductor. Therefore, a structure without via-hole conductors causes the L value of the inductor to remain the same and causes the resistance value to be decreased. Accordingly, the Q value of the inductor L is improved.

The inductor L having a larger inside diameter produces a larger inductance value of the inductor L. To achieve this, it is preferable to make the diameter of a via-hole conductor small. However, a via-hole conductor is formed by irradiating a laser beam onto an insulator layer to form a via hole, and then filling the via hole with a conductive paste. Therefore, when the diameter of a via-hole conductor is made small, it is difficult to fill the via hole with the conductive paste. Therefore, connection reliability of the inductor is decreased.

In contrast, in the electronic component 10, a via-hole conductor is not necessary in connection between the inductive conductor layer 18*a* and the inductive conductor layer 18*b*. Instead, the inductive conductor layer 18*a* is directly in contact with the inductive conductor layer 18*b*. Therefore, a process of filling a via hole with a conductive paste does not need to be performed. As described above, in the electronic component 10, a break is unlikely to occur between the inductive conductor layer 18*a* and the inductive conductor layer 18*b*. For the same reason, a break is also unlikely to occur between adjacent ones of the inductive conductor layers 18*b* to 18*j*. In the electronic component 10, the laminating direction of the insulator layers 16*a* to 16*k* is parallel to surfaces of the outer electrodes 14*a* and 14*b* which are exposed on the multilayer body 12. At this time, a direction in which magnetic flux is produced in the inside diameter of the inductor L matches the direction in which the surfaces of the outer electrodes 14*a* and 14*b* extend. Therefore, eddy-current loss produced by the outer electrodes 14*a* and 14*b* interrupting the magnetic flux may be reduced, and the Q value of the inductor L may be improved. In this case, from the viewpoint of implementation stability, irrespective of reduction in the length of the inductor L in the laminating direction (the length in the front-back direction), the length of the electronic component 10 in the front-back direction is preferably adjusted with respect to the length of the electronic component 10 in the left-right direction so that good balance is achieved. Specifically, good balance may be achieved by appropriately increasing the thicknesses of the insulator layers 16*a* and 16*k*. Thus, in the electronic component 10, reduction in the length of the inductor L in the laminating direction is a technical concept different from reduction in the size of the electronic component 10.

Figure 10:
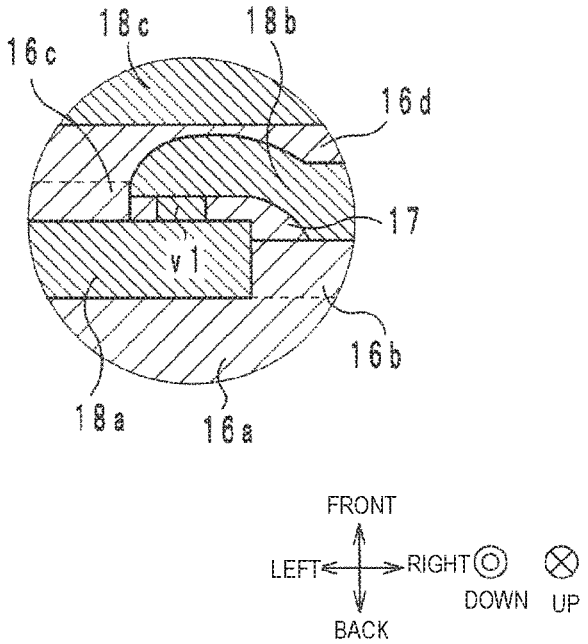
FIG. 10 is a sectional structural view of an electronic component in which inductive conductor layers are connected to each other through a via-hole conductor.
Figure 11:
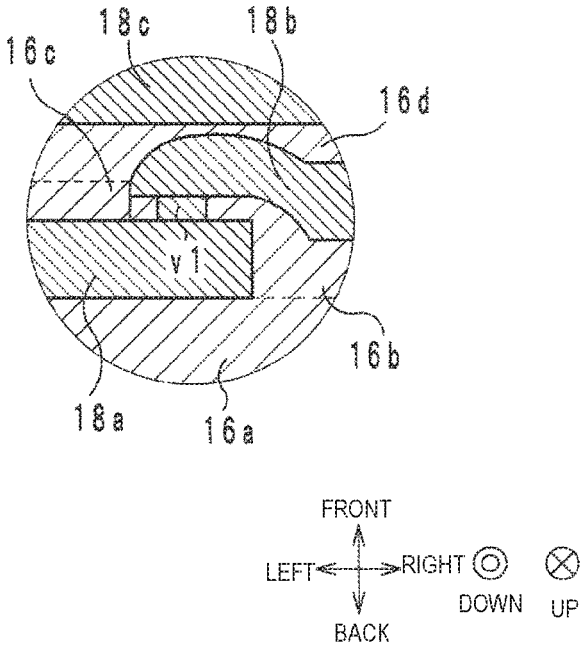
FIG. 11 is a sectional structural view of an electronic component in which the inductive conductor layers are connected to each other through the via-hole conductor.
Figure 12A:
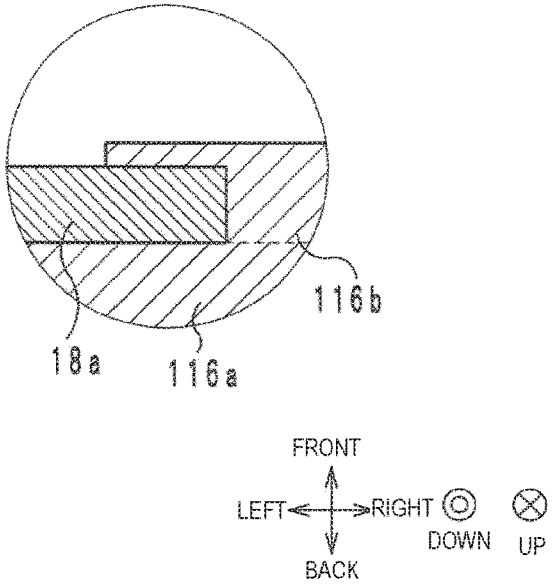
FIG. 12A is a sectional view denoting a step for manufacturing an electronic component.
Figure 12B:
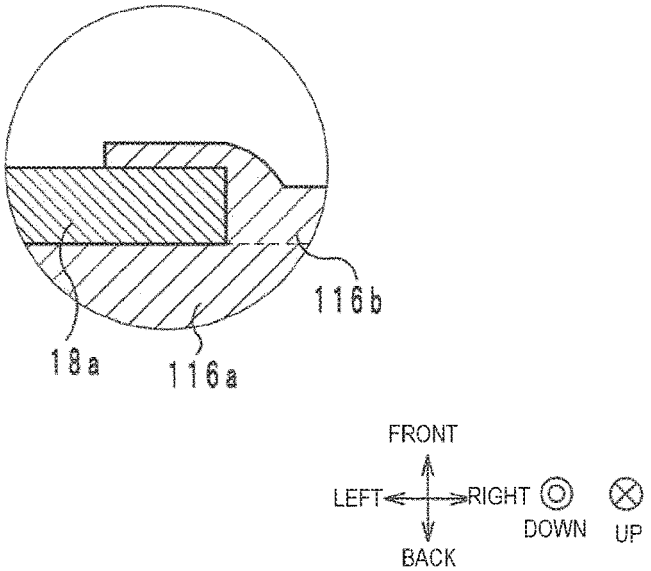
FIG. 12B is a sectional view denoting a step for manufacturing the electronic component.
Figure 12C:
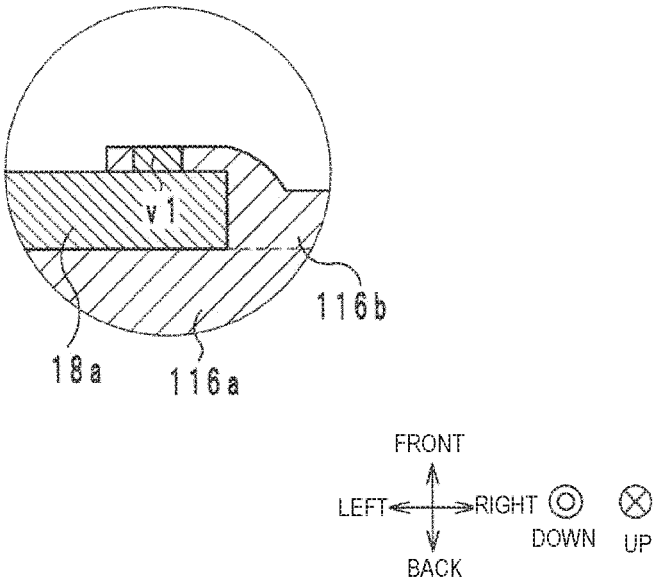
FIG. 12C is a sectional view denoting a step for manufacturing the electronic component.

In the electronic component 10, the inductive conductor layer 18*a* may be connected to the inductive conductor layer 18*b* by using a via-hole conductor. FIG. 10 is a sectional structural view of an electronic component 10*b* in which the inductive conductor layer 18*a* is connected to the inductive conductor layer 18*b* by using a via-hole conductor v1. FIG. 11 is a sectional structural view of an electronic component 10*c* in which the inductive conductor layer 18*a* is connected to the inductive conductor layer 18*b* by using the via-hole conductor v1. FIGS. 10 and 11 correspond to the enlarged view in FIG. 4A. FIGS. 12A to 12C are sectional views denoting steps for manufacturing the electronic component 10*c*.

In the electronic component 10*b*, an insulator layer 17 is disposed only in and near a portion between the downstream contact portion of the inductive conductor layer 18*a* extending in the clockwise direction and the upstream contact portion of the inductive conductor layer 18*b* extending in the clockwise direction. Thus, the downstream contact portion of the inductive conductor layer 18*a* extending in the clockwise direction is not directly in contact with the upstream contact portion of the inductive conductor layer 18*b* extending in the clockwise direction. Therefore, the via-hole conductor v1 which extends through the insulator layer 17 in the front-back direction connects the downstream contact portion of the inductive conductor layer 18*a* extending in the clockwise direction, to the upstream contact portion of the inductive conductor layer 18*b* extending in the clockwise direction. As in connection between the inductive conductor layers 18*a* and 18*b*, a via-hole conductor may be used in connection between adjacent ones of the other inductive conductor layers 18*b* to 18*j*.

In the electronic component 10*c*, the insulator layer 16*b* is disposed also in and near a portion between the downstream contact portion of the inductive conductor layer 18*a* extending in the clockwise direction and the upstream contact portion of the inductive conductor layer 18*b* extending in the clockwise direction. The via-hole conductor v1 which extends through the insulator layer 16*b* in the front-back direction connects the downstream contact portion of the inductive conductor layer 18*a* extending in the clockwise direction, to the upstream contact portion of the inductive conductor layer 18*b* extending in the clockwise direction. As in connection between the inductive conductor layers 18*a* and 18*b*, a via-hole conductor may be used in connection between adjacent ones of the other inductive conductor layers 18*b* to 18*j*.

As described above, the upstream contact portion of the inductive conductor layer 18*b* extending in clockwise direction may be formed in a portion forward from the via-hole conductor v1 interposed between the upstream contact portion of the inductive conductor layer 18*b* and the downstream contact portion of the inductive conductor layer 18*a* extending in the clockwise direction. That is, the upstream contact portion of the inductive conductor layer 18*b* extending in the clockwise direction may be formed above the downstream contact portion of the inductive conductor layer 18*a* extending in the clockwise direction. The expression "above the downstream contact portion of the inductive conductor layer 18*a* extending in the clockwise direction" encompasses not only a region positioned above the contact portion with the via-hole conductor v1 interposed between the contact portion and the region, but also a region just above the contact portion.

Formation of the insulator layer 16*b* of the electronic component 10*c* will be described. As illustrated in FIG. 12A, the insulating paste which is to become the insulator layer 16*b* is applied to the front side surface of the insulator layer 16*a*. The thickness of the insulating paste is slightly more than that of the inductive conductor layer 18*a*.

As illustrated in FIG. 12B, the insulating paste is dried. At that time, the insulating paste is shrunk and the insulating paste on the inductive conductor layer 18*a* rises higher than the other portion.

Finally, as illustrated in FIG. 12C, the via-hole conductor v1 is formed. Thus, the insulator layer 16*b* is disposed in and near a portion between the downstream contact portion of the inductive conductor layer 18*a* extending in the clockwise direction and the upstream contact portion of the inductive conductor layer 18*b* extending in the clockwise direction. Further, the via-hole conductor v1 connects the downstream contact portion of the inductive conductor layer 18*a* extending in the clockwise direction, to the upstream contact portion of the inductive conductor layer 18*b* extending in the clockwise direction.

In the electronic component 10, the laminating direction in which the insulator layers 16*a* to 16*k* are laminated is parallel to the surfaces of the outer electrodes 14*a* and 14*b* which are exposed on the multilayer body 12. In this case, the direction in which magnetic flux is produced in the inside diameter of the inductor L matches the direction in which the surfaces of the outer electrodes 14*a* and 14*b* extend. Therefore, eddy-current loss produced by the outer electrodes 14*a* and 14*b* interrupting the magnetic flux may be reduced, and the Q value of the inductor L may be improved. In this case, from the viewpoint of implementation stability, irrespective of reduction in the length of the inductor L in the laminating direction (the length in the front-back direction), the length of the electronic component 10 in the front-back direction is preferably adjusted with respect to the length of the electronic component 10 in the left-right direction so that good balance is achieved. Specifically, good balance may be achieved by appropriately increasing the thicknesses of the insulator layers 16*a* and 16*k*. Thus, in the electronic component 10, reduction in the length of the inductor L in the laminating direction is a technical concept different from reduction in the size of the electronic component 10.

Other Embodiments

An electronic component and a method for manufacturing the electronic component which are provided by the present disclosure are not limited to the electronic components 10 and 10*a* to 10*c* and the method for manufacturing the electronic components 10 and 10*a* to 10*c*, and may be changed within the scope of the gist of the present disclosure.

The configurations of the electronic components 10 and 10*a* to 10*c* and the method for manufacturing the electronic components 10 and 10*a* to 10*c* may be combined with one another in any manner.

In the electronic components 10 and 10*a* to 10*c*, any two inductive conductor layers adjacent to each other in the front-back direction among the inductive conductor layers 18*a* to 18*j* satisfy the same relationship as that between the inductive conductor layer 18*a* (exemplary first inductive conductor layer) and the inductive conductor layer 18*b* (exemplary second inductive conductor layer). However, in the electronic component 10, at least one pair of inductive conductor layers adjacent to each other in the front-back direction may satisfy the same relationship between the inductive conductor layer 18*a* (exemplary first inductive conductor layer) and the inductive conductor layer 18*b* (exemplary second inductive conductor layer).

In the electronic components 10 and 10*a* to 10*c*, the diameter of the inductor L may not be necessarily uniform, and may be different depending on positions in the front-back direction. In this case, in a certain cross section obtained by cutting the inductor L with a plane extending in the left-right and up-down directions, the inductor L may be shaped substantially like an eddy, that is, substantially like a helix in the two-dimensional structure. In the electronic components 10 and 10*a* to 10*c*, all of the inductive conductor layers 18*a* to 18*j* have a length less than the length of one turn of the inductor L. For example, at least some or all of the inductive conductor layers may helically extend while the diameter is changed. In this case, an inductive conductor layer may helically extend one turn or more.

In the electronic components 10 and 10*a* to 10*c*, the outer electrodes 14*a* and 14*b* may not necessarily include the outer conductor layers 25*a* to 25*j* and 26*a* to 26*j*. That is, the outer electrodes 14*a* and 14*b* may be formed, for example, in such a manner that an underlying electrode formed by applying a conductive paste to surfaces of the multilayer body 12 is subjected to application of Ni plating and Sn plating. The underlying electrode may be a metal film formed, for example, through sputtering. In this case, the underlying electrode is directly connected to the lead-out conductor layers 20*a* and 20*b*.

Conductive layers, such as an inductive conductor layer, an outer conductor layer, a lead-out conductor layer, and a via-hole conductor, may be formed not only through application of a conductive paste, but also, for example, through sputtering, an evaporation method, pressure bonding of foil, plating, or the like. Alternatively, as in a semi-additive method, a negative pattern may be formed, and a plating film may be formed to form a conductive pattern. Then, unnecessary portions may be removed. The main component of a conductive layer, such as an inductive conductor layer, an outer conductor layer, a lead-out conductor layer, or a via-hole conductor, may not be only Ag but also a conductive material having a low electric resistance, such as Cu or Au.

The material of the insulator layers 16*a* to 16*k* may not be only glass or a ceramic material but also an organic material such as epoxy resin, fluorocarbon polymer, or polymer resin, or a composite material such as glass epoxy resin. However, the material of the insulator layers 16*a* to 16*k* is preferably a material having a low permittivity and a low dielectric loss.

Examples of a method for applying the insulating paste for the mother insulating layers 116*a* to 116*k* include spin coating and spray coating. A screen plate covering the inductive conductor layers 18*a* to 18*i*, the lead-out conductor layers 20*a* and 20*b*, and the outer conductor layers 25*a* to 25*i* and 26*a* to 26*i* may be used to apply the insulating paste for the mother insulating layers 116*b* to 116*j*.

The size of the electronic components 10 and 10*a* to 10*c* is not limited to 0.4 mm×0.2 mm×0.2 mm.

As described above, the present disclosure is useful for an electronic component and a method for manufacturing the electronic component. In particular, the present disclosure has an excellent feature in which the length of an inductor in the laminating direction may be shortened.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body that has a configuration in which a plurality of insulator layers are laminated from a lower layer side to an upper layer side; and an inductor including a plurality of inductive conductor layers that are disposed on the plurality of insulator layers and electrically connected to one another in series, the inductor being substantially helix-shaped in such a manner as to extend helically from the lower layer side to the upper layer side, wherein the plurality of inductive conductor layers include a first inductive conductor layer and a second inductive conductor layer adjacent to the first inductive conductor layer on the upper layer side, wherein each of the first inductive conductor layer and the second inductive conductor layer has a contact portion and a linear portion, the contact portion being, when viewed in the laminating direction, overlapped by an inductive conductor layer adjacent thereto on the lower layer side or the upper layer side among the plurality of inductive conductor layers, the linear portion being not overlapped by inductive conductor layers adjacent thereto on the lower layer side and the upper layer side among the plurality of inductive conductor layers, and wherein a lower surface of the linear portion of the second inductive conductor layer is positioned higher than a lower surface of the linear portion of the first inductive conductor layer, and is positioned lower than an upper surface of the linear portion of the first inductive conductor layer.

2. The electronic component according to claim 1, wherein an upper surface of the contact portion of the first inductive conductor layer is directly in contact with a lower surface of the contact portion of the second inductive conductor layer.

3. The electronic component according to claim 1, wherein each of a length of the first inductive conductor layer and a length of the second inductive conductor layer is less than a length of one turn of the inductor.

4. The electronic component according to claim 1, wherein a sum of a length of the first inductive conductor layer and a length of the second inductive conductor layer is less than a length of one turn of the inductor.

5. The electronic component according to claim 1, wherein the second inductive conductor layer and an inductive conductor layer adjacent to the second inductive conductor layer on the upper layer side satisfy a relationship identical to a relationship between the first inductive conductor layer and the second inductive conductor layer.

6. The electronic component according to claim 1, wherein two adjacent layers of the plurality of inductive conductor layers satisfy a relationship identical to a relationship between the first inductive conductor layer and the second inductive conductor layer.

7. The electronic component according to claim 1, wherein a mounting surface of the electronic component is parallel to the laminating direction.

8. The electronic component according to claim 1, wherein the plurality of insulator layers include a first insulator layer and a second insulator layer, wherein the first inductive conductor layer is disposed on the first insulator layer, wherein the second insulator layer is disposed on the first insulator layer, wherein the second inductive conductor layer is disposed on the second insulator layer, and wherein a thickness of the second insulator layer is less than a thickness of the first inductive conductor layer.

9. The electronic component according to claim 8, wherein the plurality of insulator layers further include a third insulator layer, wherein the third insulator layer is disposed on the second insulator layer, wherein a thickness of the third insulator layer is less than a thickness of the second inductive conductor layer, and wherein a sum of the thickness of the second insulator layer and the thickness of the third insulator layer is more than the thickness of the first inductive conductor layer.

10. The electronic component of claim 1, including:

a first insulator layer;

forming the first inductive conductor layer on the first insulator layer, the first inductive conductor layer extending linearly from a first end portion to a second end portion;

forming a second insulator layer on the first insulator layer, the second insulator layer having a thickness less than a thickness of the first inductive conductor layer; and forming the contact portion of the second inductive conductor layer above the second end portion of the first inductive conductor layer and forming the linear portion of the second inductive conductor layer on the second insulator layer in such a manner that the second inductive conductor layer extends linearly from a third end portion formed above the second end portion of the first inductive conductor layer to a fourth end portion on the second insulator layer.

11. The electronic component of claim 10, wherein each of the first inductive conductor layer and the second inductive conductor layer is less than one turn.

12. The electronic component of claim 10, wherein a sum of the first inductive conductor layer and the second inductive conductor layer is less than one turn.

13. The electronic component of claim 10, including:

forming a third insulator layer on the second insulator layer, the third insulator layer having a thickness less than a thickness of the second inductive conductor layer.

14. The electronic component of claim 13, including:

forming a contact portion of a third inductive conductor layer above the fourth end portion of the second inductive conductor layer and forming a linear portion of the third inductive conductor layer on the third insulator layer in such a manner that the third inductive conductor layer extends linearly from a fifth end portion formed above the fourth end portion of the second inductive conductor layer to a sixth end portion on the third insulator layer.

15. The electronic component of claim 13, wherein a sum of the thickness of the second insulator layer and the thickness of the third insulator layer is more than the thickness of the first inductive conductor layer.

* * * * *